US006672469B2

(12) United States Patent
Hessbrueggen et al.

(10) Patent No.: US 6,672,469 B2
(45) Date of Patent: Jan. 6, 2004

(54) BEVERAGE BOTTLE AND METHOD FOR CLOSING A BEVERAGE BOTTLE

(75) Inventors: Guido Hessbrueggen, Schermbeck (DE); Peter Querbach, Dr. Rody Strasse 2, D-65375 Oestrich-Winkel (DE)

(73) Assignee: Peter Querbach, Oestrich-Winkel (DE)

( * ) Notice: Subject to any disclaimer, the term of this patent is extended or adjusted under 35 U.S.C. 154(b) by 11 days.

(21) Appl. No.: 09/756,807

(22) Filed: Jan. 9, 2001

(65) Prior Publication Data

US 2002/0003121 A1 Jan. 10, 2002

(51) Int. Cl.[7] ..... B65D 51/18; B65B 7/28

(52) U.S. Cl. ..... 215/277; 215/327; 53/486; 53/421

(58) Field of Search ..... 215/227, 246, 215/273, 277, 278, 320, 321, 327, 328, 347, 349; 53/486, 421

(56) References Cited

U.S. PATENT DOCUMENTS

| | | | | | |
|---|---|---|---|---|---|
| 1,596,996 | A | | 8/1926 | Rasmussen | |
| 1,923,091 | A | | 8/1933 | Hoffman | |
| 2,007,257 | A | * | 7/1935 | Scofield | 215/321 |
| 2,294,260 | A | * | 8/1942 | Wheaton | 215/277 |
| 2,734,650 | A | * | 2/1956 | Meyer | 215/246 |
| 2,851,183 | A | * | 9/1958 | Martinelli | 215/227 |
| 3,202,307 | A | * | 8/1965 | Rainer et al. | 215/328 |
| 3,288,320 | A | * | 11/1966 | Swanson | 215/321 |
| 3,637,103 | A | * | 1/1972 | Ptak | 215/347 |
| 4,157,143 | A | | 6/1979 | Doi | |
| 4,340,149 | A | * | 7/1982 | Mori et al. | 215/343 |
| 4,487,325 | A | | 12/1984 | Willingham | |

FOREIGN PATENT DOCUMENTS

| | | |
|---|---|---|
| EP | 0 583 229 | 8/1993 |
| FR | 1 118 209 | 6/1956 |
| FR | 2 045 066 | 2/1971 |
| FR | 2748260 | 11/1997 |
| FR | 2 769 296 | 4/1999 |

* cited by examiner

*Primary Examiner*—Nathan J. Newhouse
(74) *Attorney, Agent, or Firm*—Kenyon & Kenyon

(57) ABSTRACT

A beverage bottle, in particular a wine or sparkling wine bottle, having a bottle neck which leads into a pouring opening having a closure system which, on the one hand, makes it possible to prevent the stored beverage from being impaired in its taste even during a long storage period and, on the other hand, accommodates the esteem of the consumers to a special degree. The pouring opening is closed with a crown cap surrounded by an external packing composed of a molded cap and of a capsule which encircles the molded cap together with a part of the bottle neck. The molded cap is dimensioned so that, when the beverage bottle is closed, the impression of an upper-band mouth arises. In a method for closing the beverage bottle, the molded cap is initially connected to a starting body provided for forming the capsule and then put over the pouring opening provided with the crown cap, the starting body subsequently being rolled or shrunk onto the molded cap as well as on the respective part of the bottle neck to form the capsule.

14 Claims, 4 Drawing Sheets

BEVERAGE BOTTLE AND METHOD FOR CLOSING A BEVERAGE BOTTLE

FIELD OF THE INVENTION

The present invention relates to a beverage bottle, in particular to a wine or sparkling wine bottle, having a bottle neck which leads into a pouring opening. It further relates to a method for closing a beverage bottle of that kind.

RELATED TECHNOLOGY

In a century-long tradition, a wine bottle or a sparkling wine bottle usually has a cork or cork stopper as closure element which is introduced into the pouring opening of the bottle neck of the wine bottle. Closing wine and sparkling wine bottles in this manner has proven worthwhile, in particular, because cork, as a natural material, satisfies the preconditions given for a long-term storage of wine in the bottle to a particularly great extent. Especially with respect to processibility and tightness, cork is an inexpensive closure material involving a reasonable manufacturing outlay. Due to the long tradition in using cork for closing wine bottles, moreover, the consumers associate a cork stopper of that kind with extensive experience in the production of wine. Therefore, wine offered in a wine bottle which is closed in such a manner usually enjoys a comparatively high esteem in consumer circles.

Alternatively to using cork, a wine bottle can also be equipped with a screw closure. In this case, usually a metallic closing cap is used which is screwed on the bottle neck via a screw thread, thus closing the pouring opening of the wine bottle. A wine bottle closed with such a screw cap can be clearly distinguished from a wine bottle closed with a cork stopper already by its outer appearance. However, closure systems using screw closures are predominantly used for comparatively cheaper and, consequently, inferior wines. Because of this, moreover, a wine offered in a wine bottle having a screw closure enjoys only a lower esteem among the consumers than a wine offered in a wine bottle which is closed with a cork stopper.

Contrary to the high esteem among the consumers, however, a closure using a cork stopper can also have negative effects on the wine stored in a wine bottle closed in such a manner. In particular, as a result of contact with the wine stored in the wine bottle, a cork stopper can release flavoring substances into the wine, thus impairing or corrupting the taste of the wine. Such impairments of the wine can occur in 10 percent to 16 percent of the wine stored in such a manner. Moreover, for a sufficient sealing effect, the cork stopper must be adapted to the inside dimension of the bottle neck or of the pouring opening in a comparatively exact manner and, in addition, be treated thermally, involving a comparatively high manufacturing outlay.

SUMMARY OF THE INVENTION

Therefore, an object of the present invention is a beverage bottle, in particular, a wine or sparkling wine bottle of the type indicated above, whose closure system, on the one hand, makes it possible to prevent the beverage stored therein from being impaired in its taste even during a long storage period and, on the other hand, accommodates the esteem of the consumers to a special degree. Another object of the present invention is a method for closing a beverage bottle which is particularly suitable for attaching such a closure system.

With regard to the beverage bottle, the present invention provides a beverage bottle, in particular, a wine or sparkling wine bottle, comprising a bottle neck (4) which leads into a pouring opening (6), the pouring opening (6) being closed with a crown cap (10) which is surrounded by an external packing composed of a molded cap (22) and of a capsule (28) which encircles the molded cap together with a part of the bottle neck (4).

An advantage of the present invention is that an impairment in taste of the beverage stored in the beverage bottle, in particular of the wine stored therein, can be avoided in that cork is consequently dispensed with as closure material. To ensure a long storage life, rather a mechanically stable closure element on a metallic basis can be used. In this context, for particularly simple processibility, it can be particularly beneficial to use a crown cap as the closure element. A crown cap allows the beverage bottle to be closed using conventional equipment. However, to ensure that the good storage properties achievable in this manner are also combined with a special esteem in the buyer circles, the beverage or wine bottle, moreover, should, in its appearance, look similar to a wine bottle closed with a cork stopper. To this end, the metallic closure element is surrounded by an external packing which, in its outer appearance, copies a beverage bottle provided with a cork closure.

In this context, to maintain a particularly high dimensional stability even during different handling steps, the external packing includes a molded cap. This molded cap, together with a part of the bottle neck, is encircled by a jacket denoted as capsule, as could also be used in the case of a wine or sparkling wine bottle which is closed in a conventional manner using a cork stopper. In this context, the capsule extends beyond the molded cap, and further encircles an upper part of the bottle neck of the beverage bottle, as well. Exactly because of that, it is avoided to a special degree, that the appearance of the beverage bottle gets close to a screw cap which is considered to be inferior.

For a particularly long and stable storage life while maintaining a high tightness, the crown cap, which can be designed, in particular, in compliance with DIN 6099, is advantageously made on the basis of high-grade steel. In this case, the metal body forming the so-called "mirror" and the teeth of the crown cap is expediently composed of the material ASI 316.

In a further advantageous embodiment, the crown cap, on its side facing the interior of the bottle, is provided with a seal made of plastic in an inner region or in the region of its mirror to ensure a particularly high tightness. In this context, provision is preferably made for low-density polyethylene, which is also referred to as LD-PE, as sealing material.

For use in great quantities and for a particularly small manufacturing outlay, the molded cap is preferably made of plastic as well, in particular of high-density polyethylene which is also referred to as HD-PE.

In different situations, for example during storage or during shipping or, in particular, during the opening of the beverage bottle, the molded cap can be subject to torsional moments or moments of rotation relative to the actual bottle body. In this context, to reliably rule out a, per se, unwanted rotation of the molded cap relative to the bottle neck, the molded cap advantageously has an anti-rotation protection. To this end, in an advantageous embodiment, a number of snap-in locking elements designed, for example, in the manner of a stretched cylinder body, are integrally molded at a circumferential inner side of the molded cap. The snap-in locking elements are arranged in such a manner, that, when the molded cap is slipped over the crown cap, they each engage with a space between two neighboring teeth of the crown cap, respectively. In this context, a torque possibly acting upon the molded cap is intercepted or borne via the snap-in locking elements and the corresponding teeth of the crown cap so that the molded cap cannot rotate relative to the bottle body.

For secure attachment of the crown cap, the bottle neck of the beverage bottle preferably has a first circumferential lip bead or a lip in the immediate vicinity of the pouring opening. In the mounted condition, the crown cap embraces this lip bead with its bending lips which are arranged at its outer edge and separated by its so-called "teeth." To rule out a mechanical impairment of the mounted crown cap and, in particular, a mechanical sticking, moreover, the bottle neck advantageously has a second circumferential lip bead at, compared to the first lip bead, a slightly larger distance from the pouring opening. This lip bead is preferably dimensioned in such a manner that it protects the mounted crown cap from mechanical actions to a great extent. To this end, the second circumferential lip bead expediently has a, compared to the first circumferential lip bead, approximately one millimeter larger outside diameter. In addition, in the open condition, a bottle provided with a second lip bead in such a manner also gets close to a sparkling wine or champagne bottle in its appearance so that a special esteem can be achieved among the buyers even in the open condition.

Mechanical impairments of the crown cap can be avoided to an even greater extent by dimensioning the molded cap in such a manner that, together with the second circumferential lip bead, it forms a jacket which completely encircles the crown cap. In an embodiment of that kind, the crown cap can no longer be directly touched from the outside so that the risk of impairments or damage and, consequently, of a resulting loss in tightness is markedly reduced. To this end, in an expedient embodiment, the molded cap can be dimensioned in such a manner that, at its circumferential edge, it terminates flush with the second circumferential lip bead. However, in an alternative, particularly beneficial embodiment, the molded cap has a casing which has an essentially cylindrical design, and which is provided with a circumferential recess for accommodating the second circumferential lip bead. In this context, the recess can be formed like a channel or groove whose profile is adapted to the outer profile of the second circumferential lip bead in such a manner that, when the molded cap is mounted, an at least partially positive-locking connection results. In this manner, the molded cap is mechanically fixed in its position and, therefore, has a particularly high stability. In addition, the molded cap is supported at the bottle neck particularly well with respect to externally acting forces so that a particularly high stability and resistance arises, for example, during the mechanical attachment of the outer capsule.

In a further expedient embodiment, the molded cap is dimensioned in such a manner, that, in view of the dimensioning of the bottle neck and of the second circumferential lip bead, the impression of a so-called "upper-band mouth" arises for the beverage bottle. In the case of an upper-band mouth, the bottle has a broad circumferential bead on the bottle neck, the bead ending flush with the pouring opening. By appropriate dimensioning, it is ensured in a particularly favorable manner that for a beverage bottle, in particular a wine bottle, closed in this manner, the same esteem can be achieved among the buyers as with a wine bottle which is traditionally closed using a cork stopper.

The capsule can be made, for example, from polyethylene film laminated with aluminum on both sides or from polyvinyl chloride (PVC) but is preferably formed of tin.

With respect to the method for closing a beverage bottle, the mentioned objective is achieved in that the molded cap is initially connected to a starting body, in particular made of tin, which is provided for forming the capsule, the molded cap then being put over the pouring opening provided with the crown cap, the starting body subsequently being rolled or shrunk onto the molded cap as well as on the respective part of the bottle neck to form the capsule.

By such a sequence, a particularly time-saving and effective manufacturing process can be achieved. In particular, the molded cap can be arranged in the starting body for the capsule in the manner of a preassembly. The intermediate product prepared in such a manner can then be easily slipped over the crown cap already closing the pouring opening and put on the second lip bead of the bottle neck or brought into contact therewith. Subsequently, in the case of a capsule formed of tin, the capsule is rolled, and in the case of a capsule formed on a PVC basis, the capsule is shrunk onto the molded cap and on the upper part of the bottle neck, giving the closure system a particularly uniform and, consequently, high-quality impression. In this sequence, the beverage bottle as such is subject to the closing measures only during a comparatively short period of time so that comparatively high throughput rates are achievable.

The advantages attained using the present invention are, in particular, that, by combining a metallic closure element with a molded cap encircling the metallic closure element, it is possible, on the one hand, to achieve a high-quality closure having a high sealing effect, on the other hand, to protect the actual closure element from mechanical action. With respect to the visual effect, moreover, a comparatively traditional design can be achieved by this arrangement. It is exactly because of the casing of the molded cap and of the upper part of the bottle neck with a shared capsule that it is also guaranteed that the impression of a beverage or wine bottle having an upper-band mouth can be given so that the buyers associate a comparatively high esteem with a beverage offered in such a manner.

BRIEF DESCRIPTION OF THE DRAWINGS

An exemplary embodiment of the present invention is explained in greater detail with reference to the drawings in which.

DETAILED DESCRIPTION

In all Figures, identical parts are provided with identical reference symbols.

Figure 1:
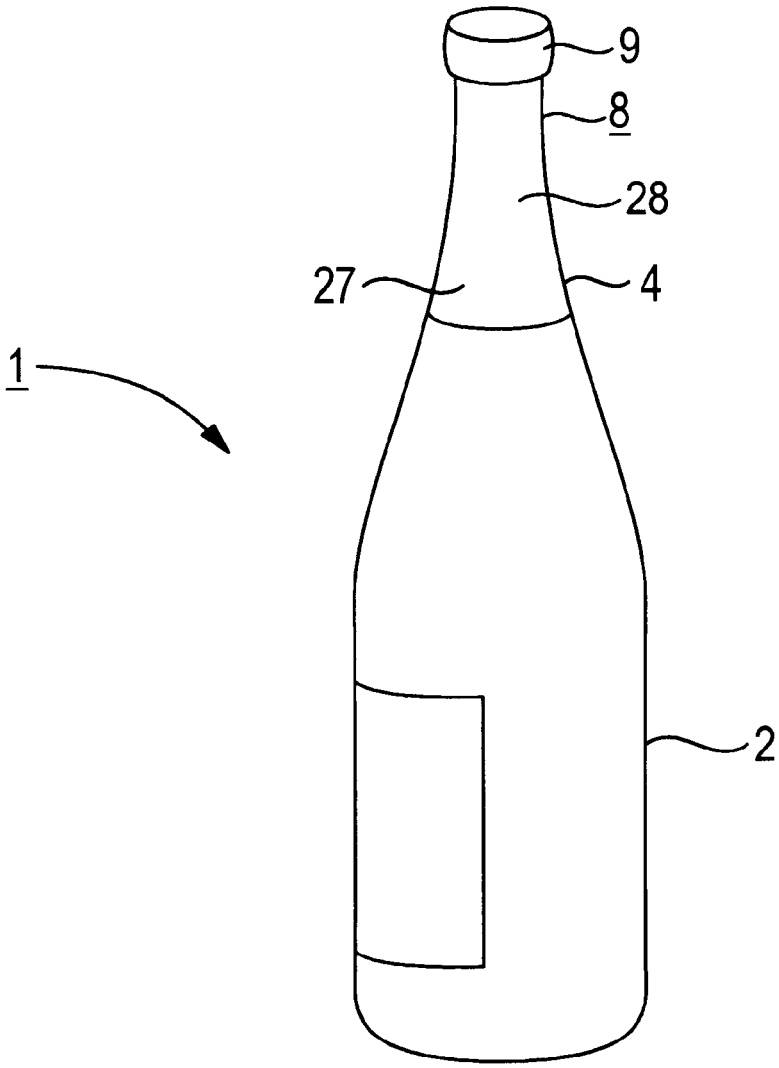
FIG. 1 shows the view of a wine bottle having a closure system.

Wine bottle 1 according to FIG. 1 includes a bottle body 2 having a bottle neck 4 integrally molded therewith. In lieu of wine bottle 1, this could also be a sparkling wine bottle. Bottle neck 4 leads into a pouring opening 6 (not shown in FIG. 1) which is closed by closure system 8. In this context, with respect to its visual impression, i.e., in particular, with respect to its dimensioning in view of the dimensioning bottle neck 4, closure system 8 is formed in such a manner, that the impression of a so-called "upper-band mouth" arises for a buyer or consumer. In this context, closure system 8 gives the outer impression of a circumferential bead 9 which is arranged at bottle neck 4 and which terminates flush with pouring opening 6.

Figure 2:
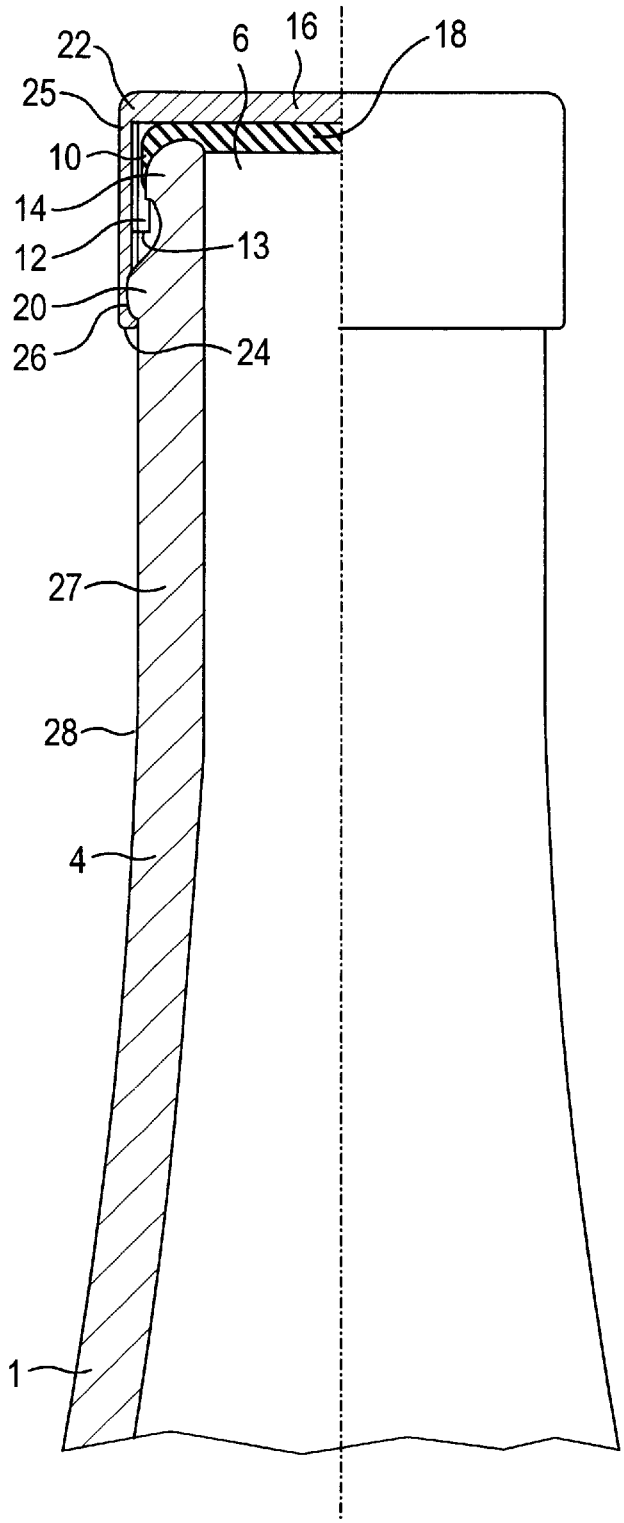
FIG. 2 shows a sectional view of the closure system of the wine bottle according to FIG. 1.
Figure 3:
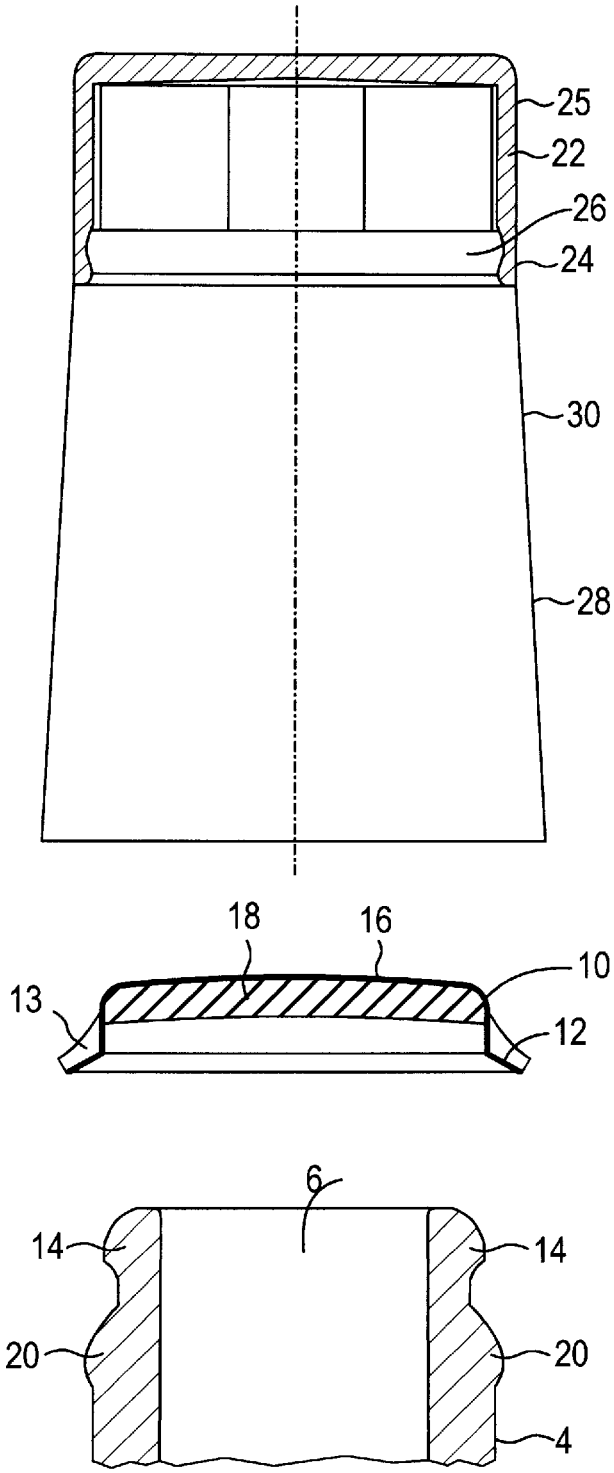
FIG. 3 shows an exploded view of the closure system according to FIG. 2.

Closure system 8 is formed in such a manner that an impairment in taste of the stored beverage, in particular, of the wine stored in wine bottle 1, is ruled out even during a long storage period. To this end, in the design of closure system 8, a cork stopper is consequently dispensed with. Instead, as shown in the sectional view in FIG. 2 and in an exploded view in FIG. 3, closure system 8 includes a crown cap 10 which closes pouring opening 6 of wine bottle 1. In this context, a number of bending lips 12 which are arranged at the outer edge of crown cap 10 and which are separated from each other by so-called "teeth" 13 of crown cap 10, embrace a first lip bead 14 which is integrally molded at bottle neck 4 in the immediate vicinity of pouring opening 6.

Crown cap 10 is designed in compliance with DIN 6099 and, adapted to the dimensioning of bottle neck 4, has a clear diameter of 26.75 mm and a height of 6.8 mm. Depending on the nominal diameter of bottle neck 4, however, other diameters, for example, 24.75 mm, 29.75 mm, 32.75 mm or 36.75 mm, can also be selected. Crown cap 10 is provided with a sealing element 18 in an inner region 16 on its side facing the interior of the bottle. In the exemplary embodiment, sealing element 18 is made of plastic, namely of low-density polyethylene (LD-PE), and dimensioned in such a manner that is completely covers pouring opening 6. With crown cap 10 in the mounted condition, sealing element 18 is completely pressed against the circumferential rim of pouring opening 6 in response to the clamping action of bending lips 12 embracing first lip bead 14 so that the pouring opening is closed completely tight. In this context, the beverage stored in wine bottle 1, in particular, the wine stored therein, can only come into contact with the material of sealing element 18. Consequently, an impairment of the stored wine, in particular in terms of taste, due to drag-in of cork material is reliably ruled out.

Crown cap 10 is made of on the basis of high-grade steel. In this context, its metal body is manufactured from the material ASI 316. Such a material selection indeed involves a slightly higher processing outlay compared to, for example, a crown cap made of tin sheet or aluminum sheet, but permits a long storage period without impairing the closing action by corrosion even in unfavorable conditions. Thus, closure system 8 is also suitable, in particular, for a long-term storage of wine even in an unfavorable, for example, salty or sulfurous outside atmosphere. At a, compared to first circumferential lip bead 14, slightly larger distance from pouring opening 6, bottle neck 4 has a second circumferential lip bead 20 which, compared to first lip bead 14 is dimensioned slightly larger and which, compared to the first lip bead, has an approximately one millimeter larger outside diameter. Second circumferential lip bead 20 ensures, one the one hand, that crown cap 10 closing pouring opening 6 is largely protected from mechanical actions, for example, due to a contact or interlocking with crown caps of other beverage bottles. Moreover, when wine bottle 1 is open, the mouth region designed in such a manner gives an impression of particularly high-quality, a qualitative approximation to a sparkling wine or champagne bottle being established especially in contrast to a bottle mouth which is prepared for a screw closure.

To further improve the mechanical protection and for ruling out an external impairment of crown cap 10, for example, during storage to the greatest possible extent, crown cap 10 is encircled by a molded cap 22 when wine bottle 1 is completely closed. When wine bottle 1 is completely closed, this molded cap is slipped over crown cap 10 and is dimensioned in such a manner that, together with lip bead 20, it forms a jacket which completely encircles crown cap 10, thus ruling out any direct mechanical contact with foreign parts. For this purpose, molded cap 22 can be dimensioned in such a manner that terminates at its circumferential edge 24 flush with second lip bead 20.

In the exemplary embodiment, molded cap 22 has a casing 25 which has an essentially cylindrical design, and which is provided with a circumferential recess 26 for accommodating the second circumferential lip bead 20. In this context, recess 26 is formed like a channel or groove whose profile is adapted to the outer profile of second lip bead 20 in such a manner that, when molded cap 22 is mounted, an at least partially positive-locking connection with second lip bead 20 results. In this manner, molded cap 22 is mechanically fixed in its position and, therefore, has a particularly high stability. Apart from that, molded cap 22 is essentially dimensioned in such a manner that, on the one hand, it can easily be slid over crown cap 10 and that, on the other hand, the impression of an upper-band mouth of wine bottle 1 arises with regard to the proportions in size, in view of the dimensioning of bottle neck 4 and of second circumferential lip bead 20.

Molded cap 22 is made of plastic, namely of high-density polyethylene (HD-PE). Molded cap 22 and an upper part 27 of bottle neck 4 are jointly encircled by a capsule 28. In this context, capsule 28 can be manufactured from a polyethylene film which is laminated with aluminum on both sides and is also referred to as "duplo film" or from polyvinyl chloride (PVC); in the exemplary embodiment, however, it is designed as a tin capsule. Molded cap 22 and capsule 28 jointly form an external packing encircling crown cap 10. In this context, capsule 28 is similar, in its make, to a bottle capsule or tin capsule usually used for a wine bottle which is closed with a cork stopper so that, in particular, with regard to the selected dimensioning of molded cap 22, of second lip bead 20, and of bottle neck 4, the impression of a wine bottle which is conventionally closed with a cork stopper results for completely closed wine bottle 1. Consequently, closure system 8 formed in such a manner not only allows a high-quality storage of the wine without impairment in taste even during a long storage period but ensures also a special esteem among the buyers because of the visual design.

Figure 4:
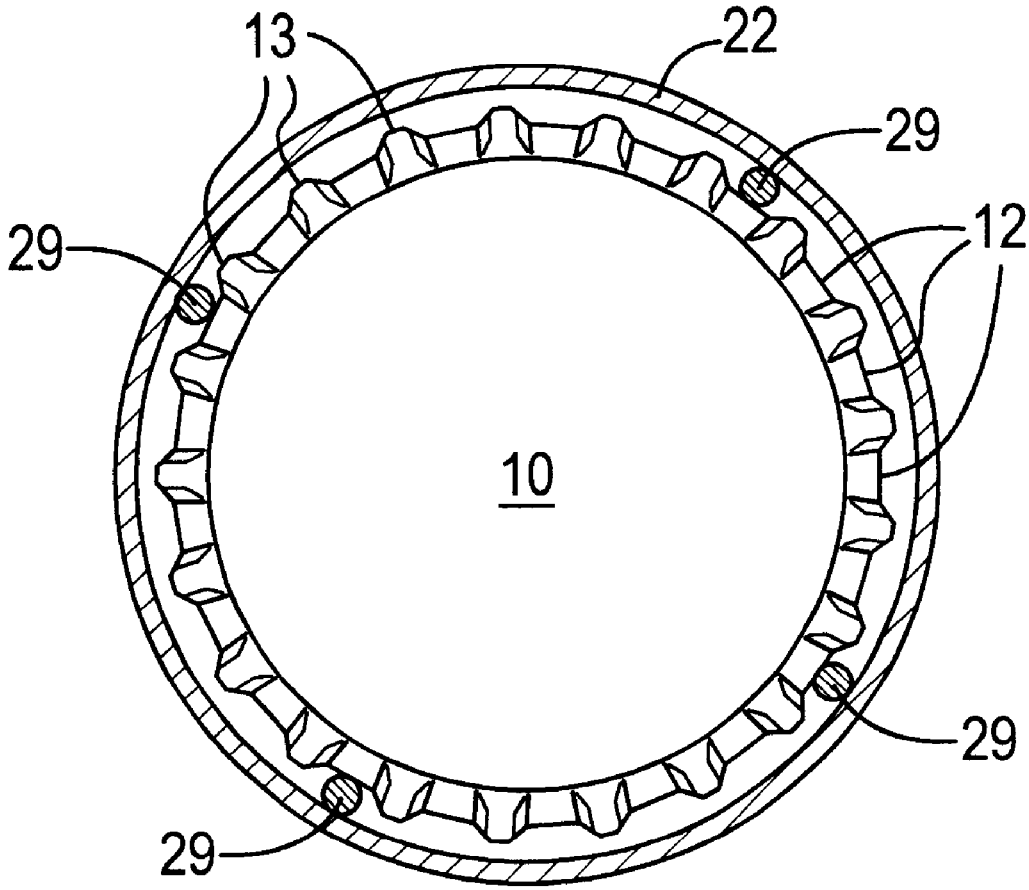
FIG. 4 shows a sectional view of a molded cap.

To reliably rule out a, per se, unwanted rotation of molded cap 22 relative to bottle neck 4, for example, during the opening of wine bottle 1, molded cap 22 has an anti-rotation protection. To this end, as shown in FIG. 4 in a top view, a number of snap-in locking elements 29 designed, for example, in the manner of a stretched cylinder body, are integrally molded at a circumferential inner side of molded cap 22. The snap-in locking elements are arranged in such a manner, that, when molded cap 22 is slipped over crown cap 10, they each engage with a space between two neighboring teeth 13 of crown cap 10, respectively. In this context, a torque possibly acting upon molded cap 22 is intercepted or borne via snap-in locking elements 29 and corresponding teeth 13 of crown cap 10 so that molded cap 22 cannot rotate relative to the bottle body 2.

To close wine bottle 1, in a first operation, pouring opening 6 is closed with crown cap 10. In a further operation parallel thereto or offset in time, molded cap 22 is brought into and cemented in a starting body 30 made, for example, of tin and provided for forming capsule 28, as especially indicated in FIG. 3. Subsequently, molded cap 22 provided with starting body 30 for forming capsule 28 is slid over crown cap 10 and over pouring opening 6 which is closed by the crown cap, second lip bead 20 snapping into recess 26. Finally, starting body 30 attached to molded cap 22 is brought into firm contact with molded cap 22 and with upper part 27 of bottle neck 4 by rolling on, capsule 28 developing in the process. In the case of a capsule made on the basis of plastic, the attachment is carried out by shrinking on in place of rolling on.

During the opening of wine bottle 1 closed in such a manner, capsule 28 is initially cut in a region beneath molded cap 22, for example, in the groove formed by the circumferential edge 24 of the molded cap and by bottle neck 4, using a suitable cutting tool. Subsequently, molded cap 22 can be pulled off bottle neck 4 in a comparatively simple manner, inter alia, because of its appropriately selected dimensioning, so that crown cap 10 is now laid bare. Thus, the crown cap is accessible for opening and can be lifted off, for example, using a cap lifter (i.e. bottle opener). The now open wine bottle 1 has a bottle neck 4 which is characterized in its mouth region by lip beads 14, 20. Thus, open wine bottle 1, in its appearance, likewise gets close to a sparkling wine bottle closed with cork so that, even in the open condition, wine bottle 1 does not give the inferior impression which is caused, for example, by a screw thread.

Thus, in the closed condition, wine bottle 1 has a closure system 8 which is corrosion-resistant even during a long storage period and which, on the one hand reliably avoids an impairment in tightness of crown cap 10 and, on the other side, gives the buyer an overall impression of high-quality. In addition, in the open condition, wine bottle 1 is characterized by a mouth region which likewise gives a high-quality impression due to lip beads 14, 20.

What is claimed is:

1. A beverage bottle including a bottle neck which defines a pouring opening, the beverage bottle comprising:

a crown cap adjacent the pouring opening for closing the pouring opening;

an external packing surrounding the crown cap, the packing opening including a molded cap and a capsule, the capsule encircling the molded cap and at least a part of the bottle neck;

a first circumferential lip bead on the bottle neck disposed in an area near the pouring opening; and a second circumferential lip bead disposed on the bottle neck a further distance from the pouring opening as the first circumferential lip, and wherein the molded cap includes a substantially cylindrical casing, the casing defining a circumferential recess for accommodating the second circumferential lip bead.

2. The beverage bottle as recited in claim 1 wherein the beverage bottle is one of a wine bottle and a sparkling wine bottle.

3. The beverage bottle as recited in claim 1 wherein the crown cap includes a high-grade steel.

4. The beverage bottle as recited in claim 1 further comprising a sealing element on a side of the crown cap that faces the bottle, the sealing element including a first plastic material.

5. The beverage bottle as recited in claim 4 wherein the first plastic material includes a low density polyethylene.

6. The beverage bottle as recited in claim 1, wherein the molded cap includes a second plastic material.

7. The beverage bottle as recited in claim 6 wherein the second plastic material includes a high-density polyethylene.

8. The beverage bottle as recited in claim 1 wherein the crown cap includes a plurality of teeth defining a plurality of spaces therebetween and the molded cap includes a plurality of locking elements integrally molded on an inner side of the molded cap facing the crown cap, wherein the locking elements are engageable with the spaces.

9. The beverage bottle as recited in claim 1 wherein the second circumferential lip bead has a larger outside diameter than an outside diameter of the first circumferential lip bead.

10. The beverage bottle as recited in claim 9 wherein the difference in the outside diameters of the first and second lip beads is approximately 1 mm.

11. The beverage bottle as recited in claim 1 wherein the molded cap is dimensioned so that a circumferential edge of the molded cap terminates flush with the second circumferential lip bead.

12. The beverage bottle as recited in claim 1 wherein the molded cap is dimensioned with respect to the dimensions of the bottle neck so as to give the appearance of an upper-band mouth.

13. The beverage bottle as recited in claim 1 wherein the capsule is made of tin.

14. A method for closing a beverage bottle including a bottle neck which defines a pouring opening, the method comprising:

placing a crown cap over the pouring opening;

connecting a molded cap to a starting body;

positioning the molded cap and starting body over the crown cap;

forming the molded cap using the starting body over the crown cap and at least a portion of the bottle neck so as to form a capsule.

* * * * *